US011717031B2

(12) United States Patent
Du

(10) Patent No.: US 11,717,031 B2
(45) Date of Patent: Aug. 8, 2023

(54) POLO SHIRT WITH NON-PLEATED COLLAR

(71) Applicant: Beijing Bao Luo Shengshi Garments Co., Ltd., Beijing (CN)

(72) Inventor: Chunbai Du, Beijing (CN)

(73) Assignee: BEIJING BAO LUO SHENGSHI GARMENTS CO., LTD., Beijing (CN)

( * ) Notice: Subject to any disclaimer, the term of this patent is extended or adjusted under 35 U.S.C. 154(b) by 0 days.

(21) Appl. No.: 17/586,378

(22) Filed: Jan. 27, 2022

(65) Prior Publication Data

US 2023/0000176 A1 Jan. 5, 2023

(51) Int. Cl.

| | |
|---|---|
| ***A41B 1/08*** | (2006.01) |
| ***A41B 3/16*** | (2006.01) |
| ***A41B 3/00*** | (2006.01) |
| ***A41D 27/00*** | (2006.01) |
| ***A41D 27/18*** | (2006.01) |
| ***A41B 3/06*** | (2006.01) |

(52) U.S. Cl.

CPC ..... *A41B 1/08* (2013.01); *A41B 3/00* (2013.01); *A41B 3/06* (2013.01); *A41B 3/16* (2013.01); *A41D 27/00* (2013.01); *A41D 27/18* (2013.01)

(58) Field of Classification Search

CPC ... A41D 1/04; A41D 1/18; A41D 1/02; A41D 27/00; A41D 27/18; A41D 27/28; A41B 1/00; A41B 1/08; A41B 1/18; A41B 1/02; A41B 3/00; A41B 3/04; A41B 3/06; A41B 3/16; A41B 2300/20; A41B 2300/22; A41B 2300/24; A41B 2300/35

USPC ..... 2/122, 115, 116

See application file for complete search history.

(56) References Cited

U.S. PATENT DOCUMENTS

| | | | | | |
|---|---|---|---|---|---|
| 273,826 | A * | 3/1883 | Dubreuil | A41B 1/08 | 2/121 |
| 404,475 | A * | 6/1889 | Galland | A41B 1/00 | 2/121 |
| 1,732,062 | A * | 10/1929 | Moore | A41B 1/00 | 2/121 |
| 2,003,217 | A * | 5/1935 | Oathout | A41B 1/00 | 2/121 |

(Continued)

FOREIGN PATENT DOCUMENTS

| | | | |
|---|---|---|---|
| CN | 101273798 | A * | 10/2008 |
| CN | 208639645 | U * | 3/2019 |

(Continued)

*Primary Examiner* — Amy Vanatta

(74) *Attorney, Agent, or Firm* — Daniel M. Cohn; Howard M. Cohn

(57) ABSTRACT

A POLO shirt with a non-pleated collar is disclosed. The shirt includes a garment body, including a front garment piece and a back garment piece, wherein front garment piece is on front side of the garment body and back garment piece is on back side of the garment body; sleeves, provided at both sides of upper part of the garment body and connected with the front and back garment piece; a collar, provided at top of the garment body and connected with the front and back garment piece, including a collar face and an elastic support strip, wherein the collar face includes a collar face body, first and second outer edges; the first outer edge is a two-layer structure, and the elastic support strip is located between two-layer structure. The first outer edge of collar is supported by elastic support strip.

7 Claims, 9 Drawing Sheets

(56) References Cited

U.S. PATENT DOCUMENTS

| | | | | | |
|---|---|---|---|---|---|
| 2,369,416 | A * | 2/1945 | Solomon | A41B 1/00 D2/858 |
| 3,131,555 | A * | 5/1964 | Rappaport | A41D 27/18 2/116 |
| 3,909,850 | A * | 10/1975 | Scott | A41B 3/00 2/132 |
| 4,385,403 | A * | 5/1983 | Richardson | A41D 27/24 2/96 |
| 2003/0140394 | A1 * | 7/2003 | Friedman | A41B 3/08 2/129 |
| 2017/0295862 | A1 * | 10/2017 | Harris | A41D 27/24 |
| 2020/0268059 | A1 * | 8/2020 | Kraikhajornkitti | A41D 1/04 |
| 2020/0397060 | A1 * | 12/2020 | O'Neal | A41B 3/06 |
| 2023/0000175 | A1 * | 1/2023 | Williams | A41B 3/00 |

FOREIGN PATENT DOCUMENTS

| | | | | | |
|---|---|---|---|---|---|
| CN | 211021029 | U * | 7/2020 | | |
| CN | 114223979 | A * | 3/2022 | | |
| WO | WO-2017179788 | A1 * | 10/2017 | | A41D 27/00 |

* cited by examiner

POLO SHIRT WITH NON-PLEATED COLLAR

TECHNICAL FIELD

The present disclosure relates to the technical field of clothing, and more specifically, to a POLO shirt with a non-pleated collar.

BACKGROUND ART

POLO shirt is a kind of short-sleeved clothes with a collar, which is one of the classic legends in the history of casual wear and has always enjoyed high occupancy in Western men's wardrobes. Because it is neither as casual as a collarless T-shirt, nor as stiff and serious as a shirt, it is ideal for commercial entertainment. Although the style of the polo shirt has not changed much since its birth, the vivid, bright colors, sweat-absorbing and breathable texture, and the casual style make it enduring on the fashion stage.

However, POLO shirt is characterized by a collar, but wearing the collar for a long time will easily lead to curling and affect the appearance and temperament, at the same time, the usual POLO shirt has only one front garment piece and one back garment piece, but the human body has a three-dimensional structure, so there is no three-dimensional sense when wearing them.

Therefore, it is urgent to develop a POLO shirt with a collar that is not easy to fold, so as to avoid curling the collar and flattening the clothes.

SUMMARY

The technical purpose of the present disclosure is to solve the problems of collar curling and flat clothes, and provide a POLO shirt with a non-pleated collar, which can make the collar not easy to curl and the clothes not flat.

As one aspect of the present disclosure, the present disclosure provides a polo shirt with a non-pleated collar, including:

a garment body, including a front garment piece and a back garment piece, wherein the front garment piece is on the front side of the garment body and the back garment piece is on the back side of the garment body;

sleeves, provided at both sides of the upper part of the garment body and connected with the front garment piece and the back garment piece; and a collar, provided at the top of the garment body and connected with the front garment piece and the back garment piece, and comprising a collar face and an elastic support strip, wherein the collar face includes a collar face body, a first outer edge and a second outer edge, wherein the first outer edge and the second outer edge are provided at the edge of the collar face body and intersected at the collar tip, the first outer edge is provided at the front side of the collar, and the second outer edge is provided at both sides and the back side of the collar; wherein the first outer edge is a two-layer structure, and the elastic support strip is located between the two-layer structure.

Further, the lower side of the first outer edge is provided with an opening for insertion and removal of the elastic support strip.

Further, the elastic support strip is made of plastic material, preferably polyurethane.

Further, the thickness of the second outer edge is 2-4 times that of the collar body, and the width of the collar body is 10-20 times that of the second outer edge.

Further, the collar further includes a collar seat and a collar face connecting part, and the bottom of the collar seat is connected with the top of the back garment piece; the collar connecting part connects the top of the collar base and the top of the collar surface; the collar connecting part is provided with multiple vent holes, and the area of each vent hole is greater than or equal to 0.25 $mm^2$ and less than or equal to 4 $mm^2$.

Further, the garment body further includes a connecting garment piece connecting the front garment piece and the back garment piece, and the connecting garment piece is provided at both sides of the garment body and under the sleeves, and the top of the connecting garment piece is connected to the sleeves by sewing.

Further, the length of the front garment piece is shorter than that of the back garment piece; the connecting garment piece includes a front garment piece connecting part and a back garment piece connecting part, wherein the front garment piece connecting part is connected with the front garment piece, the length of the front garment piece connecting part is equal to that of the front garment piece, the back garment piece connecting part is connected with the back garment piece, and the length of the back garment piece connecting part is equal to that of the back garment piece.

Further, the garment body also includes a garment seam and a reinforcing strip, wherein the garment seam is opened between the lower part of the front garment piece connecting part and the lower part of the front garment piece; the reinforcing strip is provided at the edge of the garment seam and inside the lower part of the front garment piece or the lower part of the front garment piece connecting part.

Further, the reinforcing strip includes a front garment piece reinforcing part, a connecting garment piece reinforcing part and a connecting part, wherein the reinforcing strip is formed by folding a rectangular garment piece, the middle part of the rectangular garment piece is a connecting part, two sides of the connecting part are respectively the front garment piece reinforcing part and the connecting garment piece reinforcing part, the connecting part has a double-layer structure, the first layer is an isosceles right triangle structure, the middle vertical line of the isosceles right triangle is parallel to the width of the reinforcing strip and located on the same straight line with the sewing seam, and the reinforcing strip is arranged along the isosceles right triangle; the front garment reinforcement part includes a first long side, wherein the first long side and the perpendicular bisector of the isosceles right triangle are on the same straight line, the connecting garment reinforcement part comprises a second long side, and the second long side and the perpendicular bisector of the isosceles right triangle are on the same straight line; the connection part of the folded reinforcing strip is above the garment seam, the front garment piece reinforcement part is fixed on the seam edge of the front garment piece, and the connecting garment piece reinforcement part is fixed on the seam edge of the connecting garment piece.

Further, the sleeve includes a sleeve body, a cuff connected with the outer edge of the sleeve body, a first suture and a second suture, wherein the cuff is an annular structure formed by a rectangular piece of clothing connected end to end, the cuff includes a head part, a tail part and a middle part, and the head part and the tail part overlap on the inner side of the cuff, and are stitched by a first seam to form an overlap part. The overlap part is attached to the middle part of the rectangular panel inside the cuff 22 by a second stitch line.

Further, the POLO shirt with a non-pleated collar further includes a front flap and an inner flap, wherein the front flap is provided at the front side of the upper portion of the garment body and connected to the front garment piece by sewing; the inner flap is sewed and connected with the front garment piece, and is provided at the back side of the front flap; the front flap includes the first sewing piece located at the lower part of the front flap, the inner flap includes the second sewing piece located at the lower part of the inner flap, and the front garment piece includes the third sewing piece; the first sewing piece, the second sewing piece and the third sewing piece overlap, and the second sewing piece is provided between the first sewing piece and the third sewing piece; the first sewing piece covers the second sewing piece.

Further, the POLO shirt with a non-pleated collar further includes a frame hanging piece, wherein the frame hanging piece is provided at the front side of the first sewing piece and covers the first sewing piece.

Further, the POLO shirt with a non-pleated collar further includes a pocket for holding cards, and the pocket is arranged on the sleeve.

Further, the POLO shirt with a non-pleated collar further includes a socket, and the socket is arranged on the front garment piece and used for placing a pen.

Further, the garment body, sleeves and collar are all made of pure cotton fabrics.

The disclosure has the beneficial effects that:

since the collar of POLO shirt made of cotton fabric will be edgy after being used for a long time, this scheme is supported by elastic support strips at the first outer edge of the collar, which can keep the first outer edge straight all the time, as the second outer edge is curved, the second outer edge is thickened at the second outer edge, which does not affect the beauty of the collar, and can also make the collar not easy to curl and improve the temperament of the wearer.

The side surface of the body is provided with connecting pieces, which are just equal to the width of the side surface of the human body, making the POLO shirt more three-dimensional. The lower part of the body is provided with a garment seam to facilitate the wearer to wear or sit down.

Wherein, 1—the garment body, 11—the front garment piece, 111—the third sewing piece, 12—the back garment piece, 13—the connecting garment piece, 131—the front garment piece connecting part, 132—the back garment piece connecting part, 14—the garment seam, 15—the reinforcing strip, 151—the front garment reinforcing part, 151A—the first long side, 152—the connecting part, 152A—the first layer of the connecting part, 152B—the second layer of the connecting part, 153—the connecting garment reinforcing part, 153A—the second long side, 16—the reinforcing strip suture, 2—the sleeve, 21—the sleeve body, 22—the cuff, 221—the head part, 222—the middle part, 223—the tail part, 23—the first suture, 24—the second suture, 3—the collar, 31—the collar face, 311—the collar face body, 312—the first outer edge, 312A—the upper layer of the first outer edge, 312B—the lower layer of the first outer edge, 312C—the opening, 313—the second outer edge, 32—the collar seat, 33—the collar connecting part, 34—the elastic support strip, 4—the front flap, 41—the first sewing piece, 5—the inner flap, 51—the first sewing piece, 6—the mirror rack piece, 7—the pocket, 8—the socket.

DETAILED DESCRIPTION OF THE EMBODIMENTS

The embodiments of the present disclosure will be described in detail below, but the present disclosure can be implemented in many different ways defined and covered by the claims.

Figure 1:
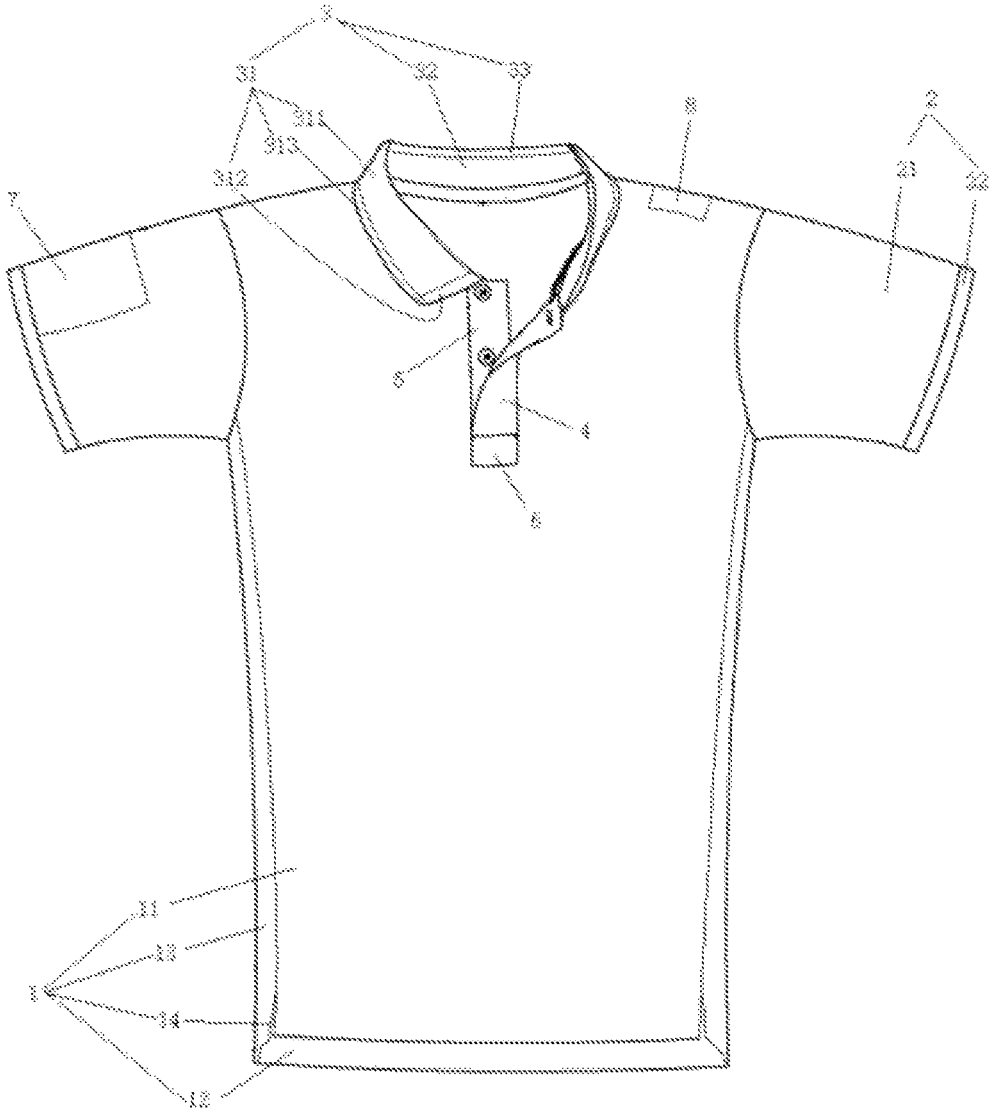
FIG. 1 schematically shows a structure diagram of a POLO shirt according to the first embodiment.

According to a first embodiment of the present disclosure, there is provided a POLO shirt with a non-pleated collar, as shown in FIG. 1, including a garment body 1, two sleeves 2, a collar 3, a front flap 4, an inner flap 5, a mirror rack piece 6, a pocket 7 and a socket 8. The garment body 1, the sleeves 2, the collar seat 32 of the collar 3, the collar connecting part 33, the collar body 31, the front flap 4, the inner flap 5, the mirror rack piece 6, the pocket 7 and the socket 8 are made of pure cotton fabric, so that the overall breathability and comfort of the POLO shirt are increased.

Figure 2:
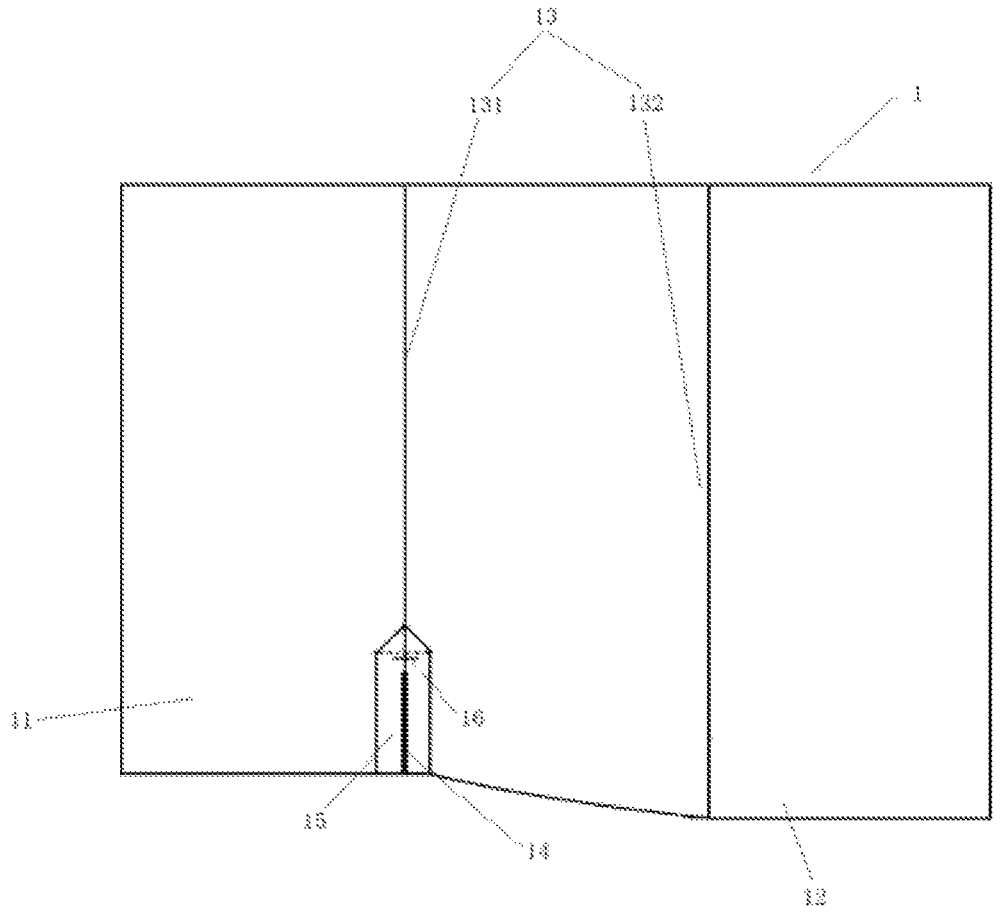
FIG. 2 schematically shows an inside structure diagram of the lower side of the garment body.
Figure 3:
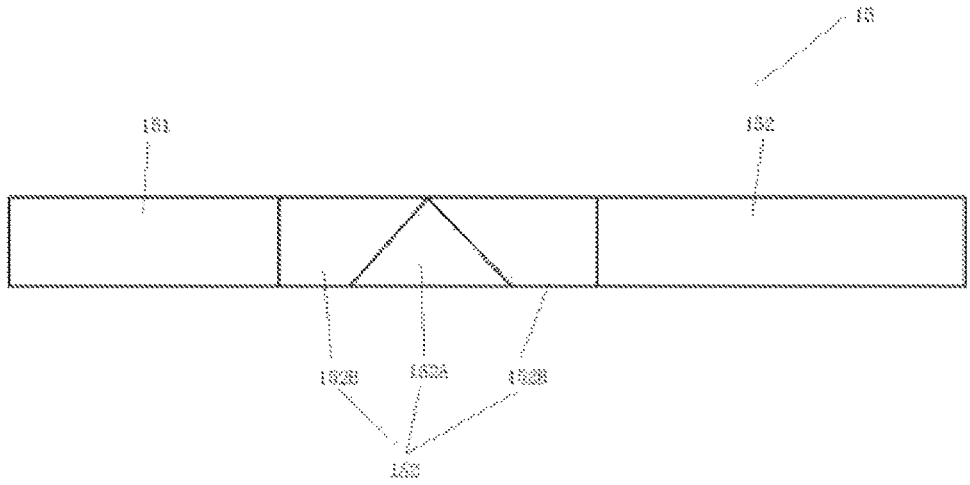
FIG. 3 schematically shows a structure diagram of the reinforcing strip before folding.
Figure 4:
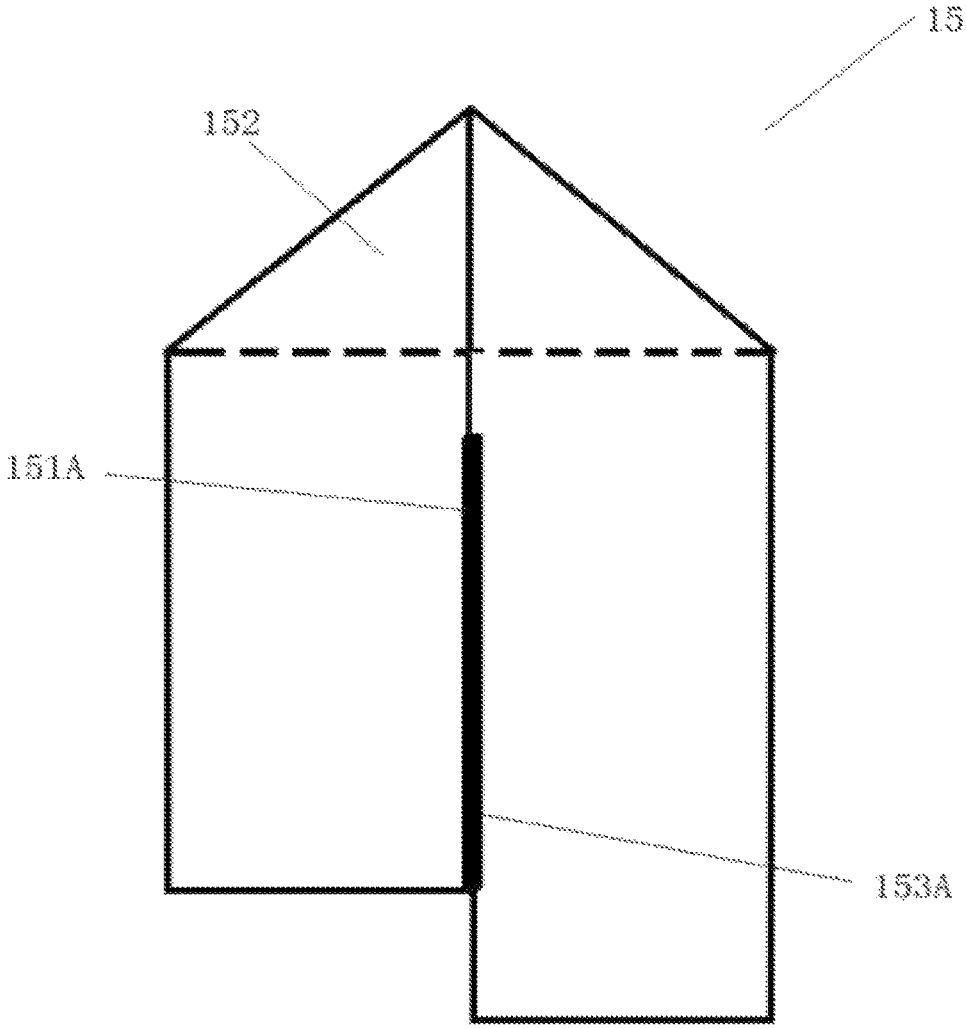
FIG. 4 schematically shows a structure diagram of the reinforcing strip after folding.
Figure 5:
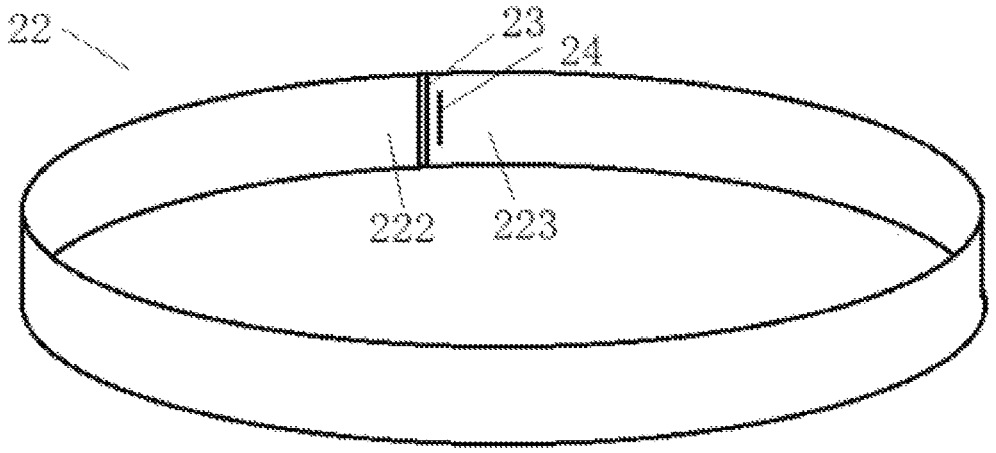
FIG. 5 schematically shows a front perspective view of the cuff.
Figure 6:
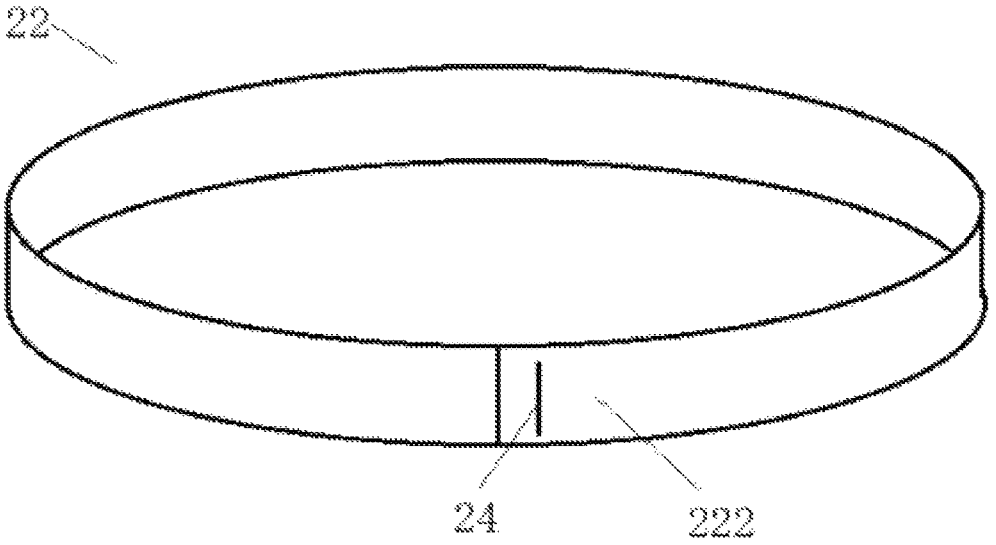
FIG. 6 schematically shows a perspective view of the back of the cuff.
Figure 7:
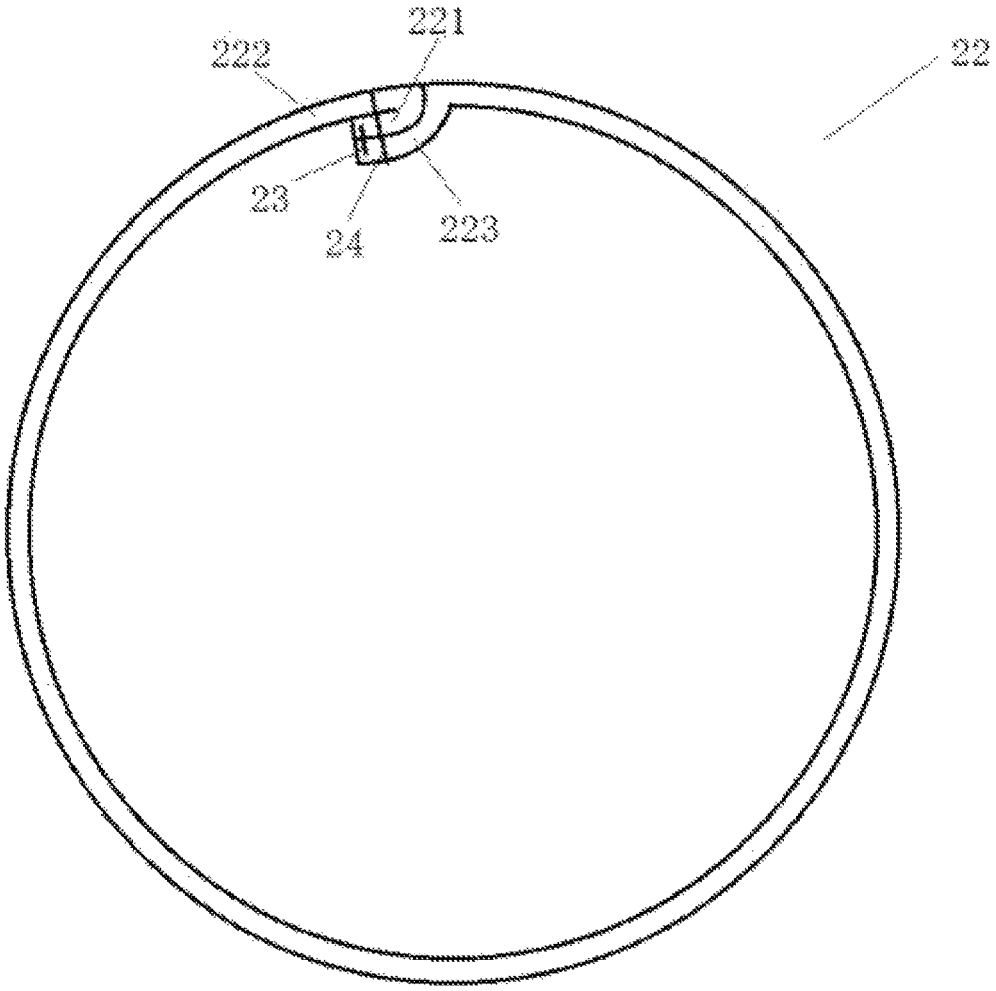
FIG. 7 schematically shows a bottom view of the cuff.

As shown in FIGS. 1-3, the garment body 1 includes a front garment piece 11, a back garment piece 12, a connecting garment piece 13, a garment seam 14, a reinforcing strip 15 and a reinforcing strip suture 16. The top of the garment body 1 is a neckline, and the neckline has an approximately inverted triangular structure, and is connected to the collar 3 by sewing. The front garment piece 11 is arranged on the front side of the garment body 1, the back garment piece 12 is arranged on the back side of the garment body 1, and the connecting pieces 13 are arranged on both sides of the garment body 1. The connecting garment piece 13 includes a front garment piece connecting part 131 and a back garment connecting piece part 132, the front garment piece connecting part 131 is connected with the front garment piece 11, and the back piece connecting part 132 is connected with the back garment piece. The connecting garment piece 13 is arranged under the sleeves 2, and the top of the connecting garment piece 13 is connected to the sleeves 2 by sewing. The length of the front garment piece 11 and the back garment piece 12 matches the length of the wearer, ranging between 50 cm and 80 cm, and the length of the front garment piece 11 is shorter than the length of the back garment piece 12. The length of the front garment piece connecting part 131 is equal to that of the front garment piece 11, and the length of the back garment piece connecting portion 132 is equal to that of the back garment piece 12. The bottom of the connecting garment piece 13 is arc-shaped to smoothly transition between the bottom of the front garment piece connecting part 131 and the bottom of the back garment piece connecting part 132. The side surface of the garment body 1 is provided with a connecting garment piece 13, which is just equal to the width of the side surface of the human body, making the POLO shirt more three-dimensional. The garment seam 14 is opened between the lower portion of the front garment piece connecting part 131 and the lower portion of the front garment piece 11 at the lower hem, and the length of the garment seam 14 is 4-6 cm, which is convenient for dressing or sitting. The reinforcing strip 15 is arranged at the edge of the garment seam 14, and is located inside the lower portion of the front garment piece 11 or the lower portion of the front garment piece connecting part 131. As shown in FIG. 3 and FIG. 4, the reinforcing strip 15 includes a front garment reinforcing part 151, a connecting garment reinforcing part 153 and a connecting part 152. The reinforcing strip 15 is formed by folding a rectangular garment with a connecting part 152 in the middle, and two sides of the connecting part 152 are respectively the front garment reinforcing part 151 and the connecting garment reinforcing part 153; the connecting part 152 is folded into a two-layer structure, and the first layer 151A is an isosceles right triangle structure, the middle vertical line of the isosceles right triangle is parallel to the width of the reinforcing strip 15 and is located on the same line with the garment seam 14; the reinforcing strip 15 is folded along two waists of an isosceles right triangle, and the folded portion is a second layer 152B of the connecting part 152, the second layer 152B of the connecting part 152 is connected to the front garment piece reinforcing part 151 and the connecting garment piece reinforcing part 153. The front garment piece reinforcing part 151 includes a first long side 151A, and the folded first long side 151A is located on the same line as the perpendicular line of the isosceles right triangle; the connecting piece reinforcing part 153 includes a second long side 153A, and the folded second long side 153A is located on the same line with the middle perpendicular line of the isosceles right triangle; the connecting part 152 of the folded reinforcing strip is located above the garment seam 14, the front garment piece reinforcing part 151 is fixed to the edge of the garment seam 14 of the front garment piece 11, and the connecting garment piece reinforcing part 153 is fixed to the edge of the garment seam 14 of the connecting garment piece 13. The reinforcing strip suture 16 is arranged above the opening of the garment seam 14, and is used to reinforce the sewing reinforcing strip 15, the front garment piece 11 and the connecting garment piece 13. As the reinforcing strip 15 only uses one garment piece, it is stronger than the existing scheme that two reinforcing strips are respectively arranged at two edges of the garment seam, at the same time, the reinforcing strip 15, the front garment piece 11 and the back garment piece 12 are reinforced again through the reinforcing strip suture 16, so that the opening of the garment seam 14 is less likely to crack and deform.

As shown in FIG. 1, the sleeve 2 is arranged on both sides of the upper part of the garment body 1, connected to the front garment piece 11 and the back garment piece 12, and the length is in a range of 12 cm to 20 cm. As shown in FIGS. 1,5-7, the sleeve 2 include a sleeve body 21, a cuff 22 connected with the outer edge of the sleeve body 21, a first suture 23 and a second suture 24. The cuff 22 is an annular structure formed by a rectangular piece of clothing connected end to end, and the cuff 22 includes a head part 221, a tail part 223 and a middle part 222, and the head part 221 and the tail part 223 overlap on the inner side of the cuff 22, and are stitched by a first seam 23 to form an overlap part. The overlap part is attached to the middle part 222 of the rectangular panel inside the cuff 22 by a second stitch line 24. By attaching and fixing the overlap part, it is possible to prevent the overlap part from rubbing against the skin and to prevent the cuff 22 from cracking.

Figure 8:
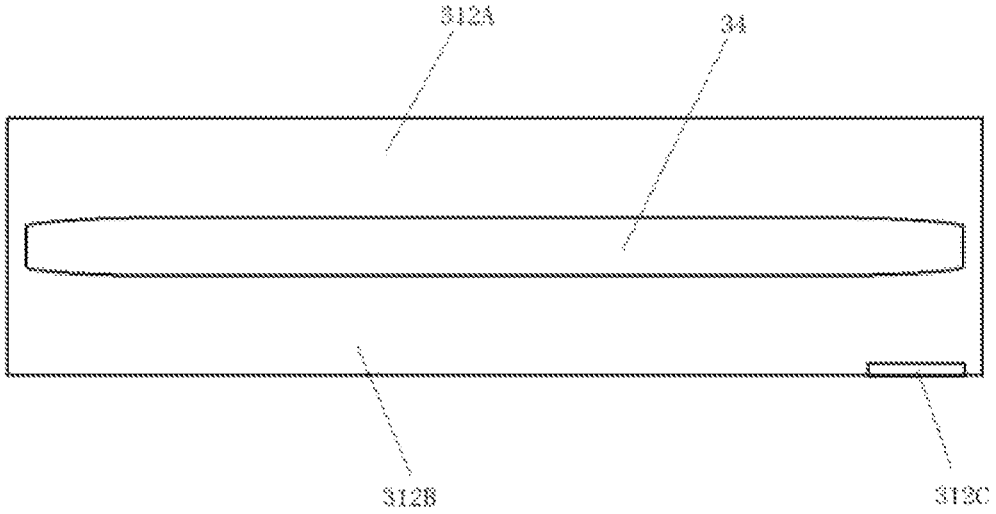
FIG. 8 schematically shows a structure diagram of the first outer edge and the elastic support strip.
Figure 9:
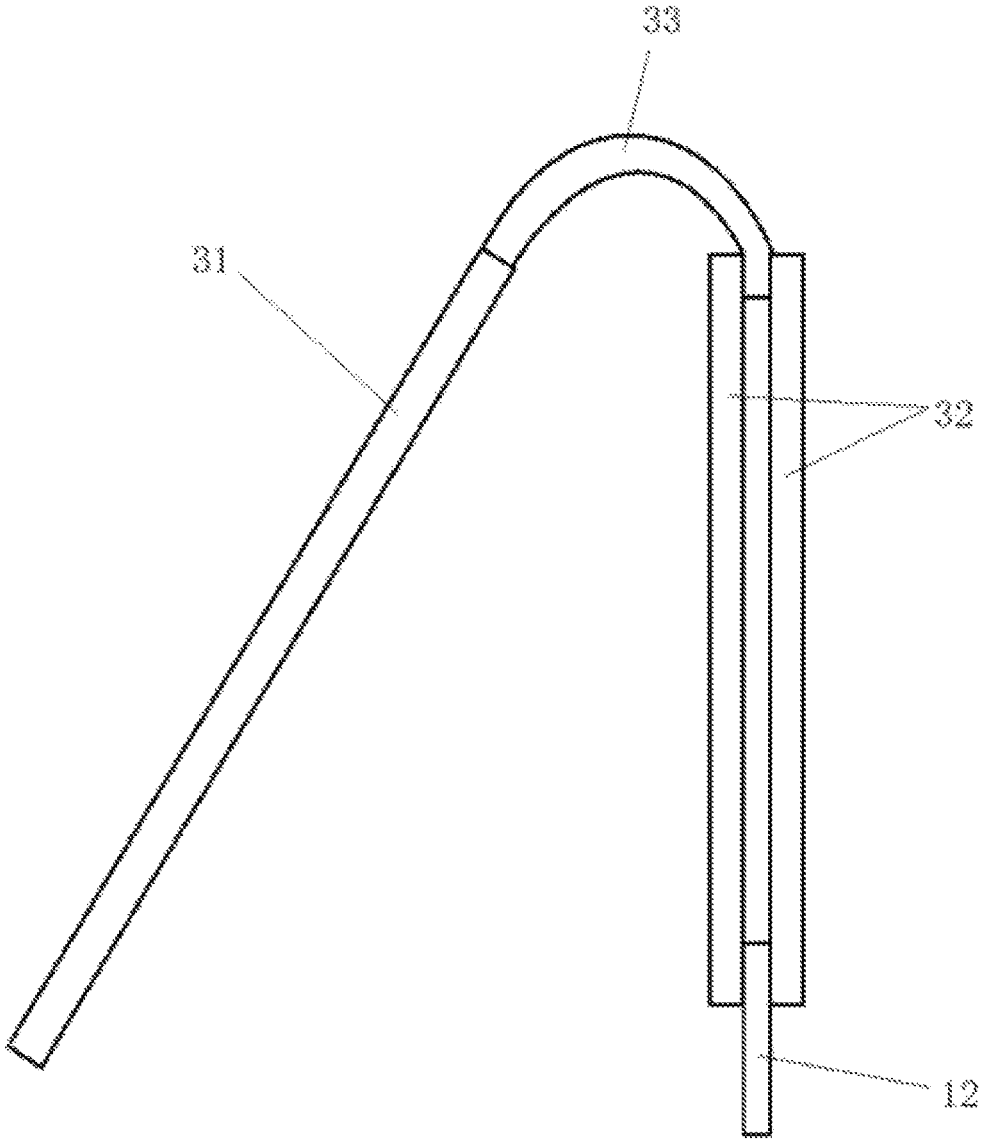
FIG. 9 schematically shows a connection diagram of the collar face, collar seat and the collar face connecting part.
Figure 10:
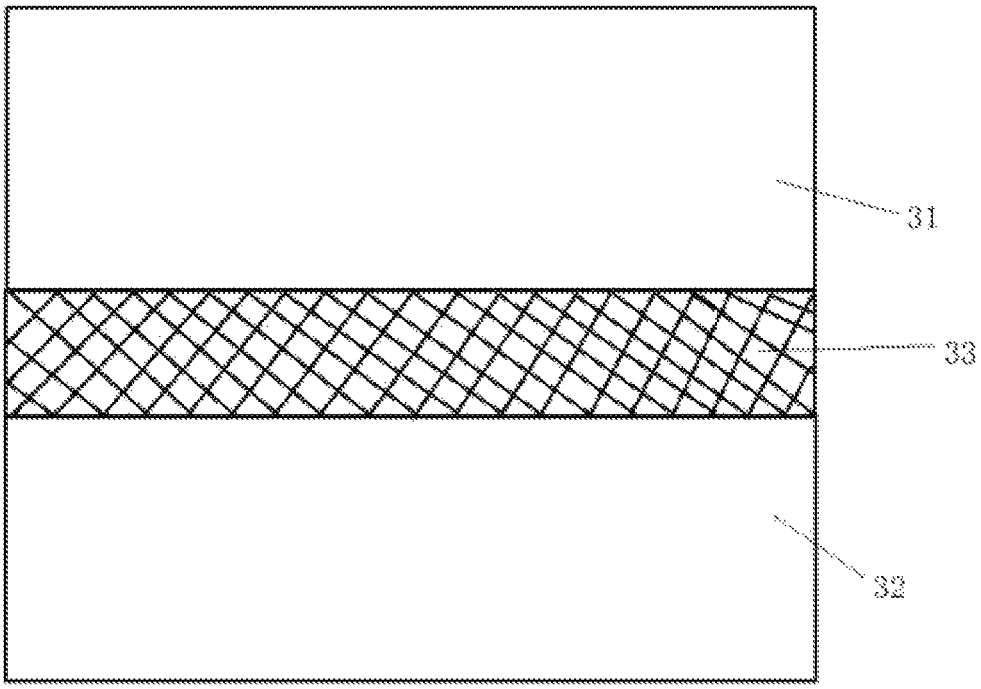
FIG. 10 schematically shows a structure diagram of the collar face, the collar seat and the collar face connecting part after being paved.

The collar 3 is arranged at the top of the garment body 1, connected with the front garment piece 11 and the back garment piece 12, and includes a collar face 31, an elastic support strip 34, a collar seat 32 and a collar face connecting part 33. As shown in FIG. 1, the collar face 31 includes a collar face body 311, a first outer edge 312 and a second outer edge 313. The first outer edge 312 and the second outer edge 313 are arranged at the edge of the collar body 1 and intersect at the collar tip, the first outer edge 312 is arranged at the front side of the collar 3, and the second outer edge 313 is arranged at both sides and the back side of the collar 3. As shown in FIG. 8, the first outer edge 312 has a double-layer structure including an upper layer 312A and a lower layer 312B. The elastic support strip 34 is arranged between the upper layer 312A and the lower layer 312B. Since the upper layer 312A and the lower layer 312B are covered with the elastic support strips 34, it is not apparent that the support structures made of different materials are used in appearance. The elastic support strip 34 is made of plastic, preferably polyurethane. Soft polyurethane mainly has thermoplastic linear structure, which has better stability, chemical resistance, resilience and mechanical properties than PVC foaming material, and less compression deformation. In order to prevent the POLO shirts from affecting the support of the elastic support strip 34 during cleaning, the lower side of the first outer edge 312 further includes an opening 312C at one end of the elastic support bar 34 for insertion and removal of the elastic support strip 34, and the opening can also be hidden due to the fact that the opening 312C is on the lower side of the first outer edge 312. The thickness of the second outer edge 313 is 2-4 times the thickness of the collar body 311, and the width of the collar body 311 is 10-20 times the width of the second outer edge 313, which makes the second outer edge 313 appear more solid and textured as an edge decoration. As shown in FIG. 1, the collar seat 32 is arranged at the back of the neck, and the collar 3 is more three-dimensional due to the support of the collar seat 32. Therefore, the width of the collar seat 32 is preferably 2.2 cm-2.8 cm. The collar seat 32 is a two-layer structure, the left side in FIG. 9 is a first layer, the right side is a second layer, the bottom of the collar base 32 is connected to the back garment piece 12 of the garment body 1, and the back garment piece 12 is sewed between the first layer and the collar seat 31 of the second layer to realize the fixed connection of the back garment piece 12 and the collar seat 32. The connecting part 33 connects the top of the collar seat 32 and the top of the collar face 31. The connecting part 33 is sewed between the collar seat 32 of the first layer and the second layer to realize the fixed connection between the connecting part 33 and the collar seat 32. As shown in FIG. 10, the collar seat 32, the connecting part 33 and the collar face 31 are paved on the same plane, the connecting part 33 is in a grid shape, and the gaps between the grids are provided with vent holes, so that the vent holes on the connecting part 33 volatilize the sweat on the back neck and prevent the sweat from accumulating and forming stains. The area of each vent hole is greater than or equal to 0.25 $mm^2$ and less than or equal to 4 $mm^2$. Under the condition that the shape of the connecting part 33 is relatively difficult to deform, in order to volatilize sweat to a greater extent and not affect the beauty, it is most appropriate to set the area of the vent hole between 0.25 $mm^2$ and 4 $mm^2$, because the area is too small to volatilize and too large to be molded. As shown in FIG. 9, the connecting part 33 is arc-shaped, with one end of the arc connected to the top of the collar seat 32 and the other end connected to the top of the collar face 31. Because the connecting part 33 has a curved shape, the shape of the connecting part 33 will not be affected by properly sized vent holes. Since the joint between the connecting part 33 and the collar face 31 is a visible part after dressing, the connecting part 33 and the collar face 31 are connected by textile technology, so that the connecting part 33 and the collar face 31 are integrally formed, and the joint between the connecting part 33 and the collar face 31 is not easy to be seen, thus improving the temperament of the wearer. The width of the collar face 31 is larger than that of the collar seat 32, so that the collar face 31 covers the collar seat 32, and the beauty of POLO shirt is improved. If vent holes are arranged on the collar seat 32, it is easy to cause the collar seat 32 to loose and collapse downward, which can not play a supporting role. The collar face 31 is a plane structure, which must be woven tightly to make the collar face 31 smooth and improve the temperament of dressing. If vent holes are provided in the collar face 31, it is not easy to fix the collar face 31 into a plane, which will easily lead to curling and non-three-dimensional phenomenon, and on the contrary, reduce the impression of people wearing clothes.

Figure 11:
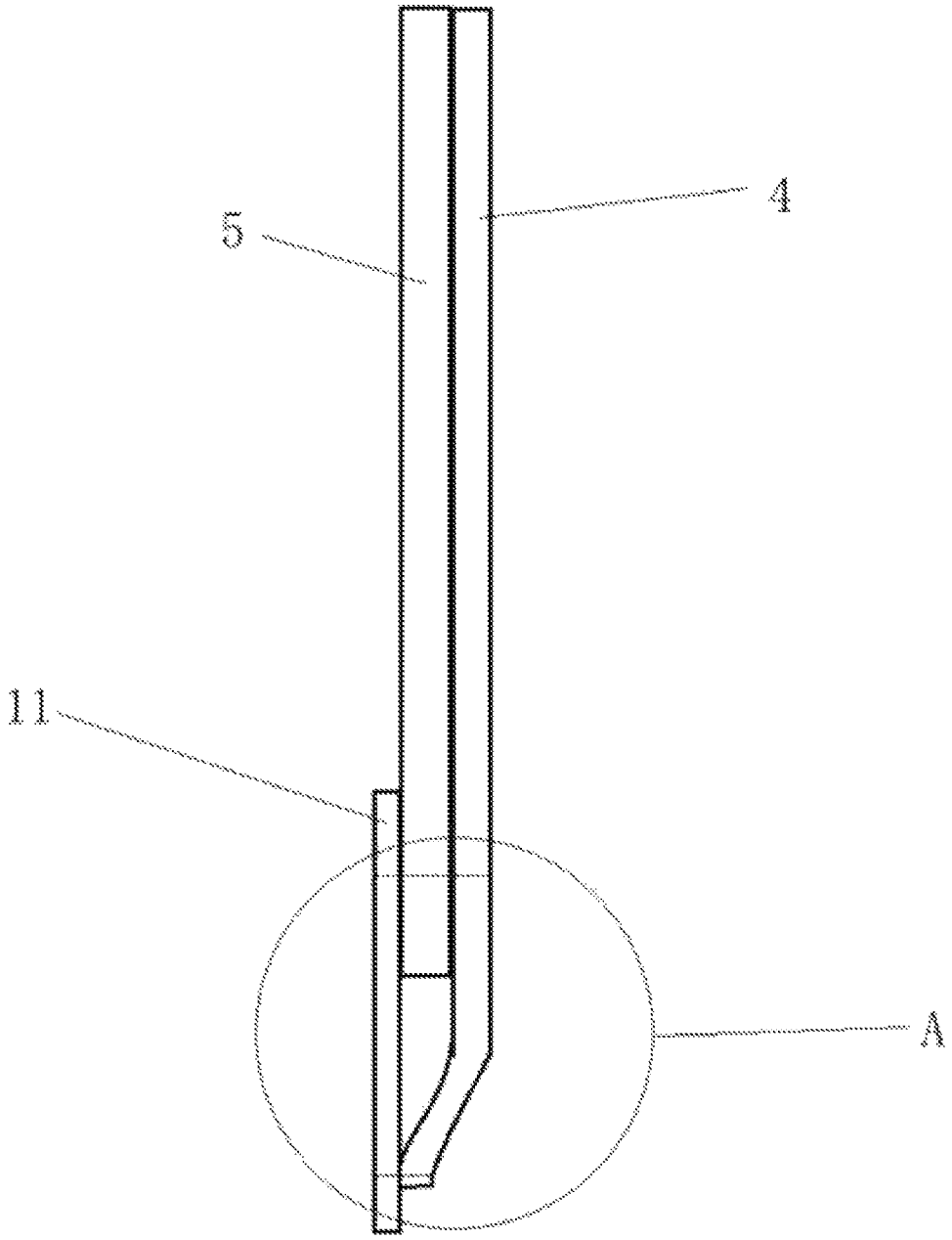
FIG. 11 schematically shows a side structure of the front flap and the inner flap.
Figure 12:
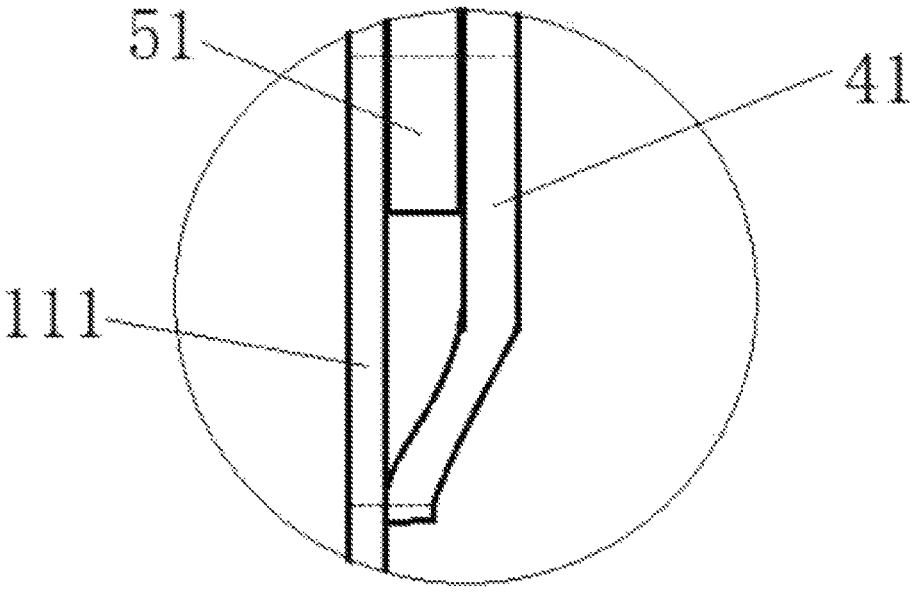
FIG. 12 schematically shows an enlarged view of A.

As shown in FIG. 1 and FIGS. 11-12, the front flap 4 is arranged at the front side of the upper portion of the garment body 1, and is connected to the front garment piece 11 by sewing. The inner flap 5 is sewed and connected with the front garment piece 11, and is arranged on the back side of the front flap 4. The front flap 4 includes the first sewing piece 41 located at the lower part of the front flap 4, the inner flap 5 includes the second sewing piece 51 located at the lower part of the inner flap 5, and the front garment piece 11 includes the third sewing piece 111. The first sewing piece 41, the second sewing piece 51 and the third sewing piece 111 overlap, and the second sewing piece 51 is arranged between the first sewing piece 41 and the third sewing piece 111. The first sewing piece 41 covers the second sewing piece 51. The frame hanging piece 6 is arranged at the front side of the first sewing piece 41 and covers the first sewing piece 41.

The pocket 7 is arranged on the sleeve 2 and is used for placing cards. The socket 8 is arranged on the front garment piece 11 for placing a pen. The POLO shirt can realize the functions of placing cards, hanging frames and inserting pens, further enhancing the temperament and convenience of users.

The foregoing is merely a preferred embodiment of the present disclosure and is not intended to limit the present disclosure, and various modifications and variations are possible for those skilled in the art. Any modification, equivalent replacement, improvement, etc. made within the spirit and principle of the present disclosure should be included in the scope of protection of the present disclosure.

What is claimed is:

1. A POLO shirt with a non-pleated collar, comprising:

a garment body, comprising a front garment piece and a back garment piece, wherein the front garment piece is on a front side of the garment body and the back garment piece is on a back side of the garment body;

sleeves, at both sides of an upper part of the garment body, are connected with the front garment piece and the back garment piece; and a collar, at a top of the garment body, is connected with the front garment piece and the back garment piece, and comprising a collar face and an elastic support strip, wherein the collar face comprises a collar face body, a first outer edge and a second outer edge, wherein the first outer edge and the second outer edge are arranged at an edge of the collar face body and intersected at a collar tip, the first outer edge is arranged at a front side of the collar, and the second outer edge is arranged at both sides of the collar; the first outer edge is a two-layer structure, and the elastic support strip is arranged between the two-layer structure;

the garment body further comprises a connecting garment piece connecting the front garment piece and the back garment piece, and the connecting garment piece is arranged at both sides of the garment body and under the sleeves, and a top of the connecting garment piece is connected to the sleeves by sewing; a length of the front garment piece is shorter than that of the back garment piece; the connecting garment piece comprises a front garment piece connecting part and a back garment piece connecting part, wherein the front garment piece connecting part is connected with the front garment piece, the length of the front garment piece connecting part is equal to the length of the front garment piece, the back garment piece connecting part is connected with the back garment piece, and the length of the back garment piece connecting part is equal to the length of the back garment piece;

the garment body also comprises a garment seam and a reinforcing strip, wherein the garment seam is opened between a lower part of the front garment piece connecting part and a lower part of the front garment piece; the reinforcing strip is arranged at an edge of the garment seam, an inner side of the lower part of the front garment piece and the lower part of the front garment piece connecting part;

the reinforcing strip comprises a front garment piece reinforcing part, a connecting garment piece reinforcing part and a connecting part, wherein the reinforcing strip is formed by folding a rectangular garment piece, a middle part of the rectangular garment piece is a connecting part, two sides of the connecting part are respectively the front garment piece reinforcing part and the connecting garment piece reinforcing part, the connecting part has a double-layer structure, a first layer is an isosceles right triangle structure, a middle vertical line of the isosceles right triangle is parallel to a width direction of the reinforcing strip and located on a same straight line with the sewing seam, and the reinforcing strip is arranged along the isosceles right triangle; the front garment reinforcement part comprises a first long side, wherein the first long side and a perpendicular bisector of the isosceles right triangle are on a same straight line, the connecting garment reinforcement part comprises a second long side, and the second long side and the perpendicular bisector of the isosceles right triangle are on the same straight line; the connection part of the folded reinforcing strip is arranged above the garment seam, the front garment piece reinforcement part is fixed on the seam edge of the front garment piece, and the connecting garment piece reinforcement part is fixed on the seam edge of the connecting garment piece.

2. The POLO shirt of claim 1, wherein a lower side of the first outer edge is provided with an opening for an insertion and a removal of the elastic support strip.

3. The POLO shirt of claim 1, wherein the elastic support strip is made of a plastic material.

4. The POLO shirt of claim 3, wherein the elastic support strip is made of a polyurethane.

5. The POLO shirt of claim 1, wherein a thickness of the second outer edge is 2-4 times of a thickness of the collar body, and a width of the collar body is 10-20 times of a width of the second outer edge.

6. The POLO shirt of claim 1, wherein the collar further comprises a collar seat and a collar face connecting part, and a bottom of the collar seat is connected with a top of the back garment piece; the collar connecting part connects a top of a collar base and a top of a collar surface; the collar connecting part is provided with a plurality of vent holes, and an area of each of the vent holes is greater than or equal to 0.25 $mm^2$ and less than or equal to 4 $mm^2$.

7. The POLO shirt of claim 1, further comprising a front flap, an inner flap, a pocket for holding cards and a piece for hanging frames; the front flap is arranged at the front side of an upper part of the garment body and is connected with the front garment piece by sewing; the inner flap is connected with the front garment piece by sewing and is arranged at a back side of the front flap; the front flap comprises a first stitched garment piece located at a lower portion of the front flap, the inner flap comprises a second stitched garment piece located at a lower portion of the inner flap, and the front garment piece comprises a third stitched garment piece; the pocket is provided on one of the sleeves.

* * * * *